US008958948B2

(12) United States Patent
Lange et al.

(10) Patent No.: US 8,958,948 B2
(45) Date of Patent: Feb. 17, 2015

(54) METHODS AND SYSTEMS FOR CONTROLLING AN ACTUATOR OF A VEHICLE LATCH

(71) Applicant: GM Global Technology Operations LLC, Detroit, MI (US)

(72) Inventors: Richard J. Lange, Troy, MI (US); James C. O'Kane, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 118 days.

(21) Appl. No.: 13/628,266

(22) Filed: Sep. 27, 2012

(65) Prior Publication Data

US 2014/0088825 A1 Mar. 27, 2014

(51) Int. Cl.

| | |
|---|---|
| ***E05B 47/00*** | (2006.01) |
| ***E05B 81/14*** | (2014.01) |
| ***E05B 81/56*** | (2014.01) |
| ***E05B 81/64*** | (2014.01) |
| ***E05B 81/82*** | (2014.01) |

(52) U.S. Cl.

USPC ..... 701/36; 701/49

(58) Field of Classification Search

CPC ..... H01M 10/443; H01M 10/5026; B60R 25/246; E05B 81/78; E05B 81/64; E05B 81/56; G07C 9/00309; E05F 15/0026; E05F 15/042; B60H 1/00428; B60P 3/20; G06F 1/3203; G01R 31/3648; H02J 7/0004; H02M 3/337; H02M 3/156; G06B 21/18; G01V 15/00

USPC ..... 296/146.4; 340/545.7, 539.13; 701/36; 62/236; 327/540; 320/132; 363/21.02

See application file for complete search history.

(56) References Cited

U.S. PATENT DOCUMENTS

| | | | | |
|---|---|---|---|---|
| 2003/0137277 | A1* | 7/2003 | Mori et al. | 320/132 |
| 2007/0171057 | A1* | 7/2007 | Ogino et al. | 340/545.7 |
| 2008/0296927 | A1* | 12/2008 | Gisler et al. | 296/146.4 |
| 2009/0229288 | A1* | 9/2009 | Alston et al. | 62/236 |
| 2011/0144861 | A1* | 6/2011 | Lakirovich et al. | 701/36 |
| 2013/0021091 | A1* | 1/2013 | Robertson et al. | 327/540 |
| 2014/0003094 | A1* | 1/2014 | Sorensen | 363/21.02 |
| 2014/0062695 | A1* | 3/2014 | Rosen et al. | 340/539.13 |

* cited by examiner

*Primary Examiner* — Tuan C. To
*Assistant Examiner* — Yuri Kan
(74) *Attorney, Agent, or Firm* — Ingrassia Fisher & Lorenz, P.C. (GM)

(57) ABSTRACT

Methods and systems are provided for unlatching a power latch system of a door. In one embodiment, a method includes determining a power mode to be at least one of a primary power mode, a backup power mode, and a series power mode; and selectively controlling power to the power latch system based on the power mode.

20 Claims, 5 Drawing Sheets

METHODS AND SYSTEMS FOR CONTROLLING AN ACTUATOR OF A VEHICLE LATCH

TECHNICAL FIELD

The technical field generally relates to methods and systems for controlling an actuator of a vehicle latch, and more particularly relates to methods and systems for controlling an actuator of a vehicle latching using a redundant power supply.

BACKGROUND

An automotive closure, such as a door for an automobile passenger compartment, is hinged to swing between open and closed positions and conventionally includes a door latch that is housed between inner and outer panels of the door. The door latch functions in a known manner to latch the door when it is closed and to lock the door in the closed position or to unlock and unlatch the door so that the door can be opened manually.

Power latch systems include a power system that electrically actuates the latching and unlatching of the door (as opposed to a mechanically actuated latching and unlatching). In some instances, such as freezing of internal or external latch levers or deformation of the latch, the latch may become stuck. When the latch becomes stuck in a power latch system, the door will not open.

Accordingly, it is desirable to provide methods and systems for unlatching the door latch when the latch becomes stuck in a power latch system. Furthermore, other desirable features and characteristics of the present invention will become apparent from the subsequent detailed description and the appended claims, taken in conjunction with the accompanying drawings and the foregoing technical field and background.

SUMMARY

Methods are provided for unlatching a power latch system of a door. In one embodiment, a method includes determining a power mode to be at least one of a primary power mode, a backup power mode, and a series power mode; and selectively controlling power to the power latch system based on the power mode.

Systems are provided for unlatching a power latch system of a door. In one embodiment, the system includes a first module that determines a power mode to be at least one of a primary power mode, a backup power mode, and a series power mode. The system further includes a second module that selectively controls power to the power latch system based on the power mode.

A vehicle is provided. In one embodiment, the vehicle includes at least one door having a power latch system. The vehicle further includes a latch control system that determines a power mode to be at least one of a primary power mode, a backup power mode, and a series power mode; and that selectively controls power to the power latch system based on the power mode.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
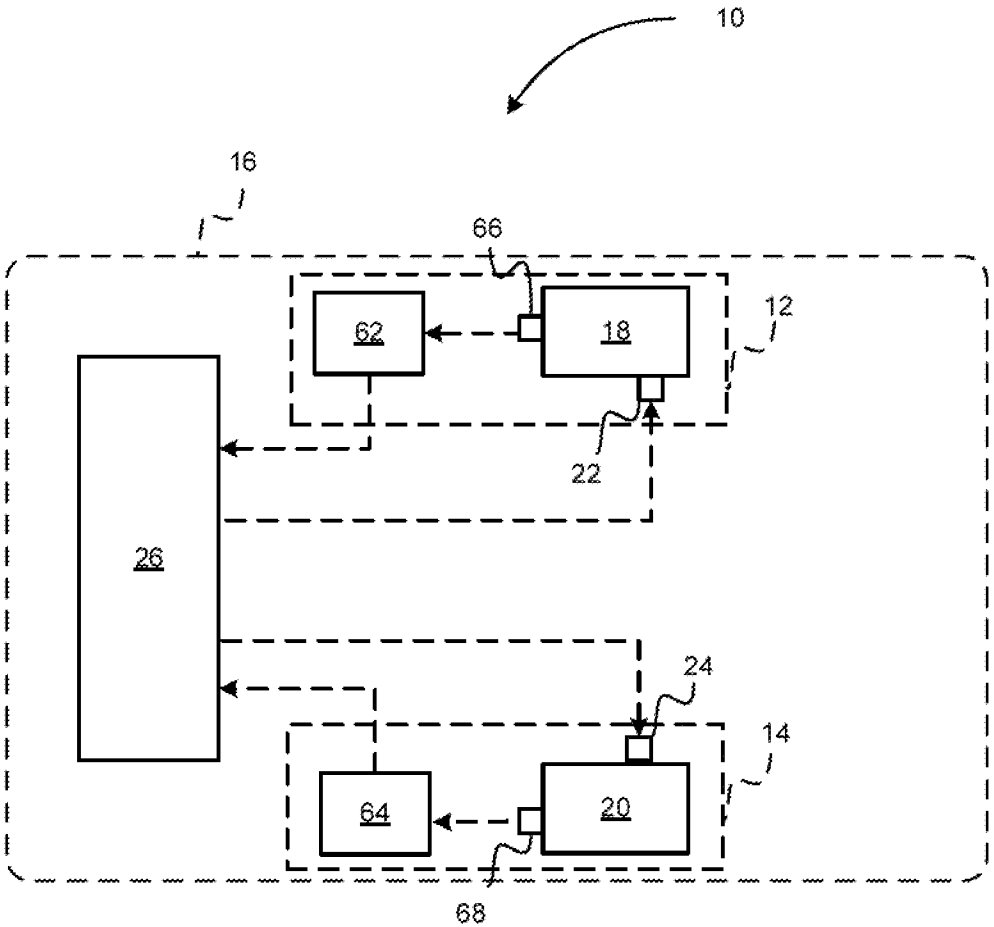
FIG. 1 is a functional block diagram illustrating a vehicle that includes a power unlatch system in accordance with various embodiments.

The following detailed description is merely exemplary in nature and is not intended to limit the application and uses. Furthermore, there is no intention to be bound by any expressed or implied theory presented in the preceding technical field, background, brief summary or the following detailed description. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Referring now to FIG. 1, a vehicle 10 is shown having a power unlatch system in accordance with various embodiments. Although the figures shown herein depict example arrangements of elements, additional intervening elements, devices, features, or components may be present in an actual embodiment. It should also be understood that FIG. 1 is merely illustrative and may not be drawn to scale.

The vehicle 10 is shown to include doors 12, 14 that couple to a vehicle body 16. As can be appreciated, although two side doors 12 and 14 are illustrated in FIG. 1, the power unlatch system of the present disclosure is applicable to any door configuration of the vehicle 10 including side front doors, side rear doors, and rear hatches. For exemplary purposes, the disclosure will be discussed in the context of the side doors 12 and 14.

The doors 12, 14 each include a door latching system 18, 20. In various embodiments, each door latching system 18, 20 generally includes a striker (not shown), a forkbolt (not shown), and a detent lever (not shown). The striker may be fixedly attached to the door 12, 14 or the vehicle body 16 (i.e. depending on implementation of the latching system 18, 20). The forkbolt moves between an unlatched position and a latched position to realeasbly capture the striker. The detent lever moves between a latched position and a released position to cause the fork bolt to move between the unlatched position and the latched position. For example, when the detent lever is in the latched position the forkbolt is in the latched position and capturing the striker; and when the detent lever is in the released position the forkbolt is in the unlatched position thus releasing the striker. An actuator 22, 24 is powered from a power system 26 to actuate the detent lever to cause the fork bolt to latch and unlatch from the striker.

Figure 2:
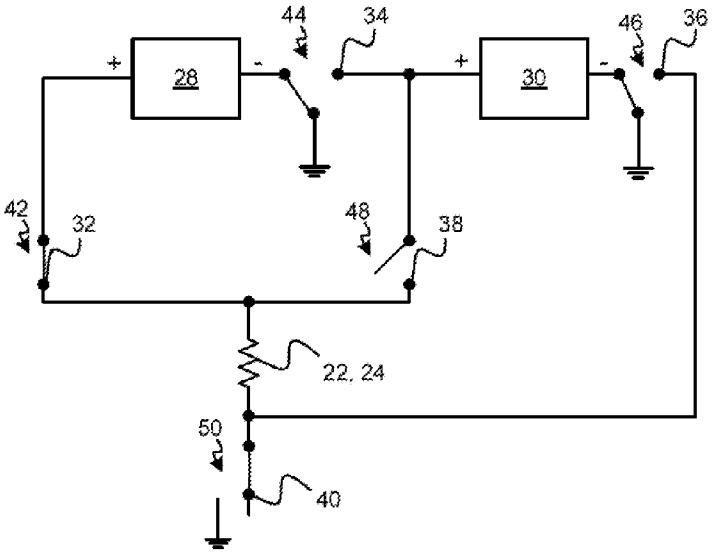
FIGS. 2-4 are schematics illustrating a power system of the power unlatch system in accordance with various embodiments.
Figure 3:
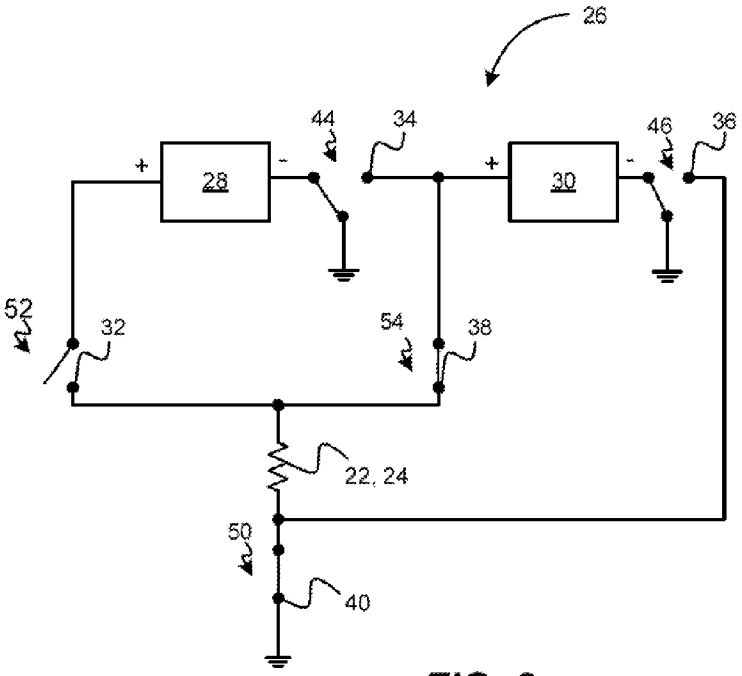
Figure 4:
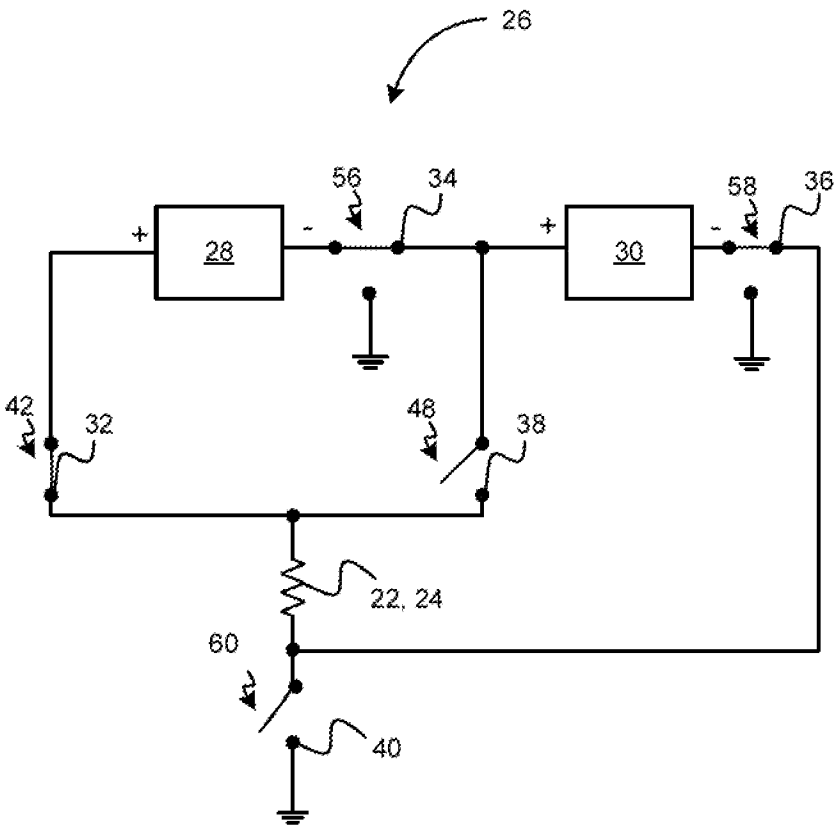

As shown in the more detailed FIGS. 2-4, the power system 26 includes a primary power source 28, a backup power source 30, and a plurality of switches 32-40. The primary power source may be, for example, a vehicle battery. The backup power source 30 may be, for example, an auxiliary battery associated with the vehicle 10 or with the particular door 12, 14. As can be appreciated, the primary power source 28 and the backup power source 30 can include, but are not limited to, batteries, capacitors, super capacitors, inductors, or any combination including "boost circuits" or any other electrical energy storage devices. The primary power source 28 and the backup power source 30 are arranged in a series configuration. In various embodiments, the polarity of the power sources 28 and 30 can be as shown in FIGS. 2-4 or can be reversed. So long as the configuration is a series configuration.

As can be appreciated, the plurality of switches 32-40 may be provided for both doors 12, 14 or may be provided as a set of switches 32-40, one set for each door 12, 14 or actuator 22, 24. The plurality of switches 32-40 are selectively opened and closed to provide power to the actuator 22, 24 from the primary power source 28, the backup power source 30, and/or both the primary power source 28, and the backup power source 30.

For example, as shown in FIG. 2, when switch 32 is in a closed position 42, switch 34 is in an open position 44, switch 36 is in an open position 46, switch 38 is in an open position 48, and switch 40 is in a closed position 50, power is supplied from the primary power source 28 to the actuator 22, 24. In another example, as shown in FIG. 3, when switch 32 is in an open position 52, switch 34 is in the open position 44, switch 36 is in the open position 46, switch 38 is in a closed position 54, and switch 40 is in the closed position 50, power is supplied from the backup power source 30 to the actuator 22, 24. In yet another example, as shown in FIG. 4, when switch 32 is in the closed position 42, switch 34 is in a closed position 56, switch 36 is in a closed position 58, switch 38 is in the open position 48, and switch 40 is in an open position 60, power is supplied from the primary power source 28 and the backup power source 30 to the actuator 22, 24.

With reference back to FIG. 1, a control module 62, 64 controls the power to the actuator 22, 24 by controlling the switches 32-40 (FIGS. 2-4) of the power system 26 based on sensed signals received from a position sensor 66, 68 and/or modeled data indicating a status of the latching system 18, 20 and further based on the power unlatch systems and methods of the present disclosure. In general, the power unlatch systems and methods of the present disclosure selectively control the switches 32-40 (FIGS. 2-4) of the power system 26 such that power is supplied to the actuator 22, 24 from the primary power source 28 (FIGS. 2-4), the backup power source 30 (FIGS. 2-4), and/or both the primary power source 28 (FIGS. 2-4), the backup power source 30 (FIGS. 2-4).

Figure 5:
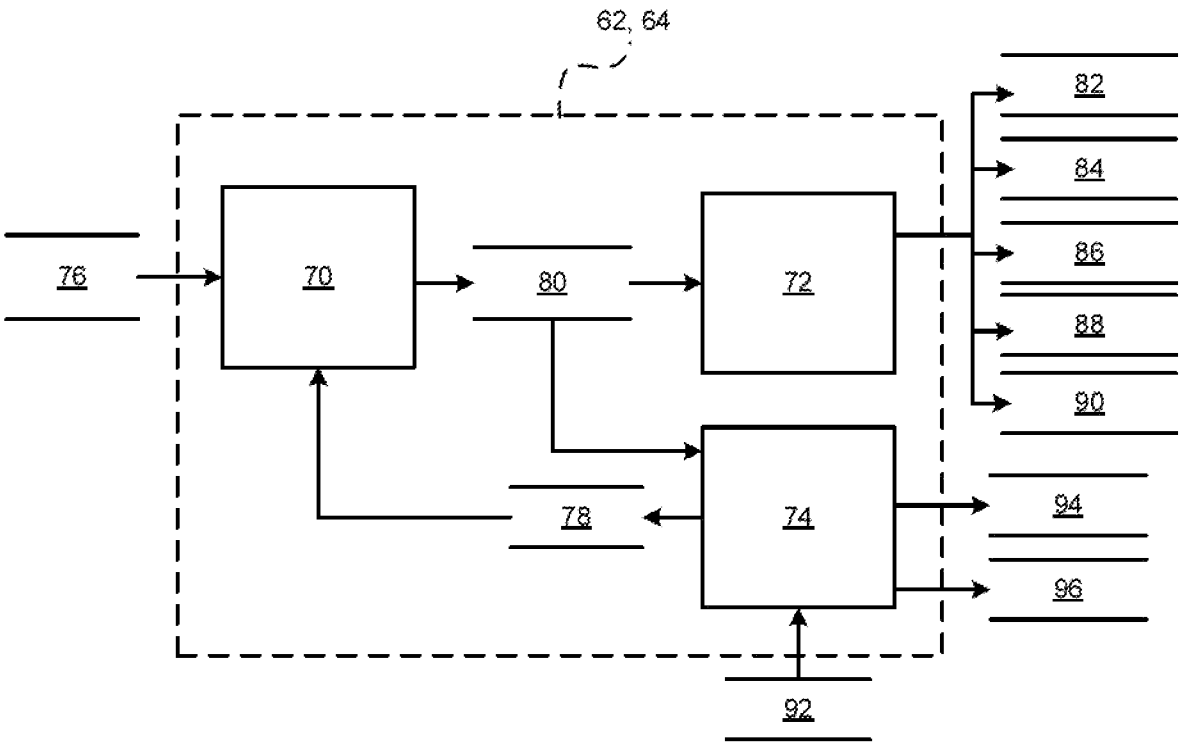
FIG. 5 is dataflow diagram illustrating a power unlatch system in accordance with various embodiment.

Referring now to FIG. 5, a dataflow diagram illustrates various embodiments of a power unlatch system that may be embedded within the control module 62, 64. Various embodiments of power unlatch systems according to the present disclosure may include any number of sub-modules embedded within the control module 62, 64. As can be appreciated, the sub-modules shown in FIG. 5 may be combined and/or further partitioned to similarly monitor and control the latching system 18, 20 (FIG. 1). Inputs to the system may be sensed from the latching system 18, 20 (FIG. 1), received from other control modules (not shown), and/or determined/modeled by other sub-modules (not shown) within the control module 62, 64. In various embodiments, the control module 62, 64 includes a power mode determination module 70, a switch control module 72, and a latch monitoring module 74.

The power mode determination module 70 receives as input an open request 76, and a lever status 78. The open request 76 indicates an intent to open the door 12, 14 (FIG. 1) and can be initiated, for example, by a user lifting a handle of the door, a signal received from a switch that has been activated by a user, or a signal received from a remote device that has been initiated by a user. In various embodiments, the lever status 78 indicates a released position or a latched position of the detent lever of the latching system 18, 20 (FIG. 1).

The power mode determination module 70 evaluates the open request 76 and the lever status 78 to determine a power mode 80. In various embodiments, the power mode 80 can be at least one of a primary power mode, a backup power mode, a series power mode, and a series pulse power mode. When the open request 76 is first received, the power mode determination module 70 sets the power mode 80 to the primary power mode. When the open request 76 is received a second time (or any other N number of times) and the lever status 78 indicates that the detent lever has not moved and the latch has not opened, the power mode determination module 70 sets the power mode 80 to the backup power mode. Alternatively, when a time T (e.g., 250 milliseconds, or other time) has expired and a subsequent open request 76 has not been received and the lever status 78 still indicates that the detent lever has not moved and the latch has not opened, the power mode determination module 70 sets the power mode 80 to the backup power mode.

When the open request 76 is received a third time (or other N number of times) and the lever status 78 still indicates that the lever has not moved and the latch has not opened, the power mode determination module 70 sets the power mode 80 to the series mode. Alternatively, when a time T (e.g., 250 milliseconds, or other time) has expired and a subsequent open request 76 has not been received and the lever status 78 still indicates that the detent lever has not moved and the latch has not opened, the power mode determination module 70 sets the power mode 80 to the series power mode.

If the power mode 80 is the series mode, the lever status 78 indicates that the detent lever has not moved and the latch has not opened after a predetermined time T, the power mode determination module 70 sets the power mode 80 to the series pulse power mode.

In various embodiments, the order of operating the modes may be modified every X number of open requests or Y cycles through the modes (e.g., 20 cycles or other number). For example, the power mode 80 would be set to the backup power mode first and if the detent lever did not move, the power mode 80 would be set to the primary power mode. If there is still no detent movement, then the power mode 80 is set to the series mode. As can be appreciated, the power mode determination module 70 may determine the operating modes in any order, and may alternate the determining of the operating mode between two or more orders.

The switch control module 72 receives as input the power mode 80. Based on the power mode 80, the switch control module 72 generates control signals 82-90 to control the position of the switches 32-40 (FIGS. 2-4). For example, when the power mode 80 is the primary power mode, the switch control module 72 generates control signals 82-90 such that power is supplied to the actuator 22, 24 (FIG. 2) by the primary power source 28 (FIG. 2). In the embodiments shown in FIG. 2, control signal 82 is generated to close switch 32, control signal 84 is generated to open switch 34, control signal 86 is generated to open switch 36, control signal 88 is generated to open switch 38, and control signal 90 is generated to close switch 40.

In another example, when the power mode 80 is the backup power mode, the switch control module 72 generates control signals 82-90 such that power is supplied to the actuator 22, 24 (FIG. 2) by the backup power source 30 (FIG. 3). In the embodiments shown in FIG. 3, control signal 82 is generated to open switch 32, control signal 84 is generated to open switch 34, control signal 86 is generated to open switch 36, control signal 88 is generated to close switch 38, and control signal 90 is generated to close switch 40.

In yet another example, when the power mode 80 is the series mode, the switch control module 72 generates control signals 82-90 such that power is supplied to the actuators 22, 24 (FIG. 4) by both the primary power source 28 (FIG. 4) and the backup power source 30 (FIG. 4). In the embodiments shown in FIG. 4, control signal 82 is generated to close switch 32, control signal 84 is generated to close switch 34, control signal 86 is generated to close switch 36, control signal 88 is generated to open switch 38, and control signal 90 is generated to open switch 40.

In yet another example, when the power mode 80 is the series pulse mode, the switch control module 72 generates control signals 82-90 such that power is pulsed to the actuators 22, 24 (FIG. 4) by both the primary power source 28 (FIG. 4) and the backup power source 30 (FIG. 4).

The latch monitoring module 74 receives as input the power mode 80, and a lever position 92. In various embodiments, the lever position 92 is a sensor signal indicating a movement or position of the detent lever or the latch of the latching system 18, 20. Based on the inputs 80, 92, the latch monitoring module 74 generates the lever status 78 and in some cases generates a warning message 94 and/or a warning signal 96.

For example, when the power mode 80 is the primary power mode, the backup power mode, the series power mode, or the series pulse power mode and the lever position 92 indicates that the detent lever or the latch has moved, the lever status 78 is set to indicate movement of the detent lever and the latch and the warning message 94 and/or warning signal 96 is not generated. When the power mode 80 is the primary power mode or the backup power mode and the lever position 92 indicates that the detent lever and the latch has not moved, the lever status 78 is set to indicate no movement of the detent lever and the warning message 94 and/or the warning signal 96 is not generated. When the power mode 80 is the series power mode or the series pulse power mode and the lever position 92 indicates that the detent lever or the latch has not moved, the lever status 78 is set to indicate no movement of the detent lever and the warning message 94 and/or the warning signal 96 is generated. For example, the warning message 94 and/or the warning signal 96 are generated based on a number Z of cycles X through the modes without successfully moving the detent lever (either consecutive or non-consecutive).

In various embodiments, the warning message 94 may include a diagnostic code that indicates a latch fault. The warning message 94 may be communicated to an occupant of the vehicle 10 (FIG. 1) via a message center (not shown) of the vehicle 10 (FIG. 1), may be communicated to a remote location via a telematics system (not shown) of the vehicle 10 (FIG. 1), and/or may be retrieved by a technician via a technician tool (not shown) that communicatively couples to a communication bus of the vehicle 10 (FIG. 1). In various embodiments, the warning signal 96 is a control signal that illuminates a warning lamp or LED (not shown) of the vehicle 10 (FIG. 1) or door 12, 14 (FIG. 1), and/or is a control signal that activates a warning chime or message of an audio system (not shown) of the vehicle 10 (FIG. 1).

Figure 6:
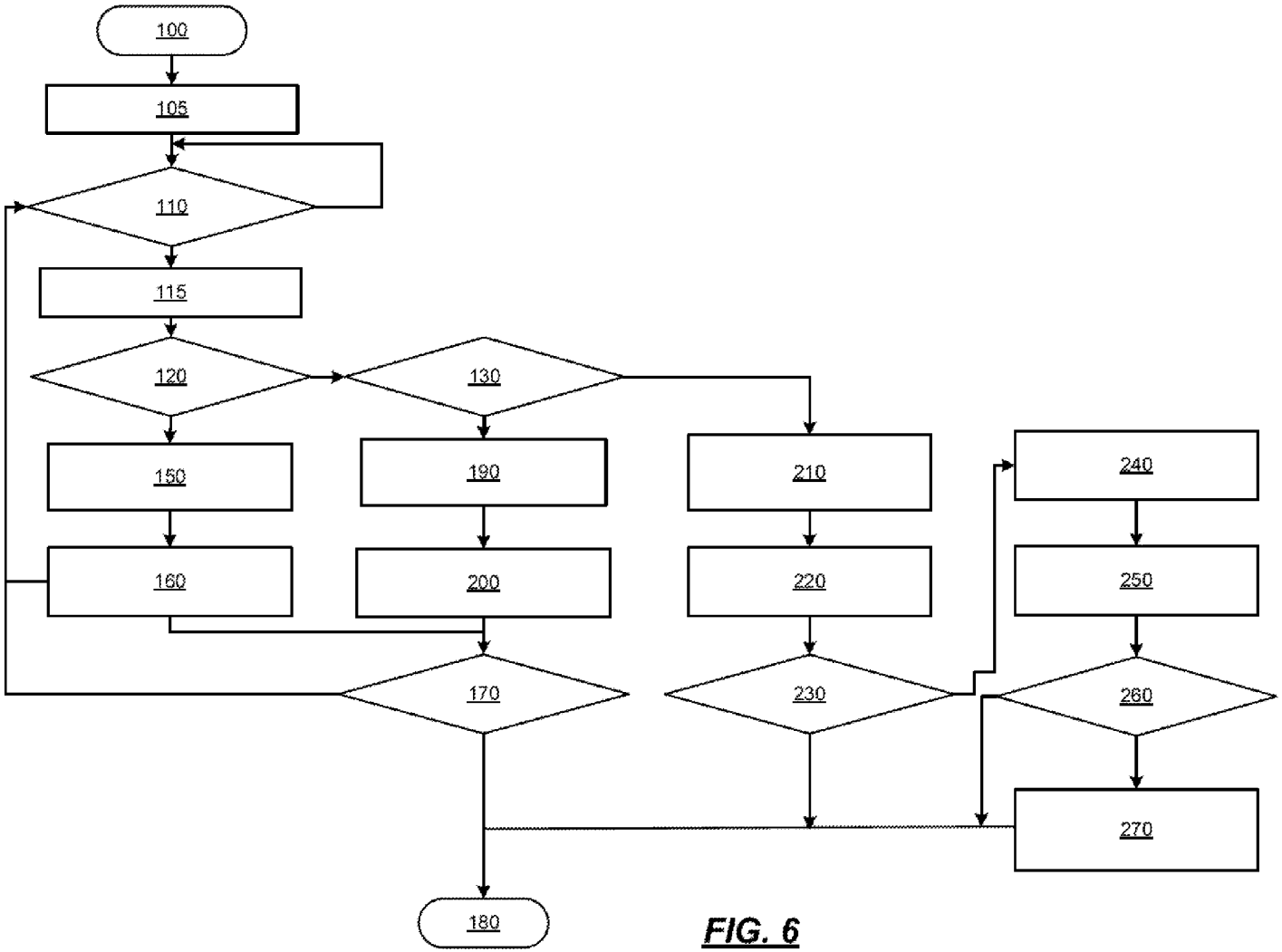
FIG. 6 is a flowchart illustrating a power unlatch method in accordance with various embodiments.

Referring now to FIG. 6, and with continued reference to FIGS. 1 and 5, a flowchart illustrates a control method that can be performed by the control module 62, 64 of FIG. 1 in accordance with the present disclosure. As can be appreciated in light of the disclosure, the order of operation within the method is not limited to the sequential execution as illustrated in FIG. 6, but may be performed in one or more varying orders as applicable and in accordance with the present disclosure.

In various embodiments, the method can be scheduled to run based on predetermined events, and/or can run continually during operation of the latch system 18, 20.

In one example, the method may begin at 100. An open attempt count is initialized to zero at 105. It is determined whether an open request 76 has been received at 110. If an open request 76 has been received at 110, a timer is started at 114. The number of attempts to open the latch (attempt count) is incremented at 115 and evaluated at 120 and 130. For example, if the open request 76 is a first attempt to unlatch the latch at 120 (e.g., the attempt count equals one), the power mode 80 is set to the primary power mode at 150 and the switch control signals 82-90 are generated at 160 to control power from the primary power source 28 to the actuator 22, 24 of the latch system 18, 20. After the control signals 82-90 are generated, the lever status 78 is evaluated to determine if the detent lever or the latch has moved at 170. If the detent lever has moved at 170, the method may end 180.

If, however, the detent lever has not moved at 170, the method continues with monitoring for an open request 76 at 110. If an open request 76 is not received at 110, the timer is evaluated at 165. If the timer has reached a predetermined time (e.g., 120 milliseconds or other time), the method continues at 115 with resetting the timer at 114, incrementing the attempt counter at 115, and determining the open attempt at 120 and 130. If, however, the timer has not yet reached the predetermined time at 165, the method continues to monitor for an open request 76 at 110.

If, at 110, an open request 76 is received, and the open request 76 is not the first attempt to unlatch the latch at 120 rather, it is the second attempt at 130 (e.g., the attempt count equals two or other N number), the power mode 80 is set to the backup power mode at 190 and the switch control signals 82-90 are generated at 200 to control power from the backup power source 30 to the actuator 22, 24 of the latch system 18, 20. After the control signals 82-90 are generated, the lever status 78 is evaluated to determine if the detent lever has moved at 170. If the detent lever has moved at 170, the method may end 180. If, however, the detent lever has not moved at 170, the method continues with monitoring for an open request 76 at 110 and monitoring the timer at 165.

If, at 110, an open request 76 is received, and the open request 76 is not the first attempt to unlatch the latch at 120 and it is not the second attempt to unlatch the latch at 130, rather it is the third attempt (e.g., the attempt count equals three or other N number), the power mode 80 is set to the series power mode at 210 and the switch control signals 82-90 are generated at 220 to control power from both the primary power source 28 and the backup power source 30 to the actuator 22, 24 of the latch system 18, 20.

After the control signals 82-90 are generated, the lever status 78 is evaluated to determine if the detent lever has moved at 230. If the detent lever has moved at 230, the method may end 180. If, however, the detent lever has not moved at 230, the power mode 80 is set to the series pulse power mode at 240 and the switch control signals 82-90 are generated at 250 to pulse power from both primary power source 28 and the backup power source 30 to the actuator 22, 24 of the latch system 18, 20.

After the control signals 82-90 are generated, the lever status 78 is evaluated to determine if the detent lever has moved at 260. If the detent lever has moved at 260, the method may end 180. If, however, the detent lever has not moved at 260, the number of attempts to open the door or cycles through the attempts to open the door is evaluated and a warning message 94 and/or a warning signal 96 is generated to provide notification of the stuck latch at 270. Thereafter, the method may end at 180.

As can be appreciated, the method may similarly be implemented with the order of the power modes being varied. For example, the backup power mode may be determined after the first attempt and the primary power mode may be determined after the second attempt. In another example, either the primary power mode or the backup power mode may be determined after the first attempt and the series power mode may be determined after the second attempt. As can further be appreciated, a method having a first order may be performed for N cycles and thereafter a method having a second order may be performed for N cycles. Thereafter, the methods can alternate.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method for unlatching a power latch system of a door, comprising:

determining, by a processor, a power mode to be one of a primary power mode where power is to be supplied from a primary power source, a backup power mode where power is to be supplied from a backup power source, and a series power mode where power is to be supplied from both the primary power source and the backup power source based on an evaluation of a received request; and selectively controlling, by the processor, power to the power latch system based on the power mode.

2. The method of claim 1 wherein the determining the power mode comprises determining the power mode to be the primary power mode when an open request is first received.

3. The method of claim 2 wherein the selectively controlling the power to the power latch system comprises selectively controlling power to the power latch system from a primary power source when the power mode is the primary power mode.

4. The method of claim 1 wherein the determining the power mode comprises determining the power mode to be the backup power mode when an open request is received N number of times and a lever status indicates that the power latch system is latched, wherein N is an integer greater than one.

5. The method of claim 4 wherein the selectively controlling the power to the power latch system comprises selectively controlling power to the power latch system from a backup power source when the power mode is the backup power mode.

6. The method of claim 1 wherein the determining the power mode comprises determining the power mode to be the series power mode when an open request is received X number of times and the lever status indicates that the power latch system is latched, wherein X is an integer greater than two.

7. The method of claim 6 wherein the selectively controlling the power to the power latch system comprises selectively controlling power to the power latch system from a primary power source and a backup power source when the power mode is the series power mode.

8. The method of claim 7 wherein the selectively controlling power to the power latch system from the primary power source and the backup power source in series when the power mode is the series power mode.

9. The method of claim 1 wherein the determining the power mode comprises determining the power mode to be the primary power mode and wherein the method further comprises:

changing the power mode to be the backup power mode after the selectively controlling.

10. The method of claim 9 further comprising:

selectively controlling the power to the power latch system based on the backup power mode;

changing the power mode to the series power mode after the selectively controlling the power based on the backup power mode; and selectively controlling the power to the power latch system based on the series power mode.

11. A control system for unlatching a power latch system of a door, the control system comprising:

a first module that determines a power mode to be one of a primary power mode where power is to be supplied from a primary power source, a backup power mode where power is to be supplied from a backup power source, and a series power mode where power is to be supplied from both the primary power source and the backup power source based on an evaluation of a received request; and a second module that selectively controls power to the power latch system based on the power mode.

12. The control system of claim 11 wherein the first module determines the power mode to be the primary power mode when an open request is first received.

13. The control system of claim 12 wherein the second module selectively controls the power to the power latch system from a primary power source when the power mode is the primary power mode.

14. The control system of claim 11 wherein the first module determines the power mode to be the backup power mode when an open request is received N number of times and a lever status indicates that the power latch system is latched, wherein N is an integer greater than one.

15. The control system of claim 14 wherein the second module selectively controls the power to the power latch system from a backup power source when the power mode is the backup power mode.

16. The control system of claim 11 wherein the first module determines the power mode to be the series power mode when an open request is received X number of times and a lever status indicates that the power latch system is latched, wherein X is an integer greater than two.

17. The control system of claim 16 wherein the second module selectively controls the power to the power latch system from a primary power source and a backup power source when the power mode is the series power mode.

18. The control system of claim 17 wherein the second module electively controls power to the power latch system from the primary power source and the backup power source in series when the power mode is the series power mode.

19. The control system of claim 11 wherein the first module determines the power mode to be the primary power mode, then determines the power mode to be the backup power mode, and then determines the power mode to be the series power mode.

20. A vehicle, comprising:

at least one door having a power latch system; and a latch control system that determines a power mode to be one of a primary power mode where power is to be supplied from a primary power source, a backup power mode where power is to be supplied from a backup power source, and a series power mode where power is to be supplied from both the primary power source and the backup power source based on an evaluation of a received request; and that selectively controls power to the power latch system based on the power mode.

* * * * *